US011835887B2

(12) United States Patent
Tsuchiya et al.

(10) Patent No.: US 11,835,887 B2
(45) Date of Patent: Dec. 5, 2023

(54) DEVELOPER ACCOMMODATING DEVICE WITH SCREW INCLUDING SCREW BLADE AS ROTATOR, DEVELOPING DEVICE, PROCESS CARTRIDGE, AND IMAGE FORMING APPARATUS

(71) Applicants: Yuuki Tsuchiya, Kanagawa (JP); Yoshihiro Fujiwara, Kanagawa (JP); Tomohiro Kubota, Kanagawa (JP); Shuntaroh Tamaki, Kanagawa (JP); Ryusuke Mase, Kanagawa (JP)

(72) Inventors: Yuuki Tsuchiya, Kanagawa (JP); Yoshihiro Fujiwara, Kanagawa (JP); Tomohiro Kubota, Kanagawa (JP); Shuntaroh Tamaki, Kanagawa (JP); Ryusuke Mase, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/751,673

(22) Filed: May 24, 2022

(65) Prior Publication Data

US 2022/0397841 A1 Dec. 15, 2022

(30) Foreign Application Priority Data

Jun. 10, 2021 (JP) ..... 2021-097116

(51) Int. Cl.
*G03G 15/08* (2006.01)

(52) U.S. Cl.
CPC ..... *G03G 15/0891* (2013.01); *G03G 15/0898* (2013.01); *G03G 2215/083* (2013.01); *G03G 2221/1648* (2013.01)

(58) Field of Classification Search
CPC ..... G03G 15/0891; G03G 15/0893; G03G 2215/0838; G03G 2215/0819; G03G 2215/0822; G03G 2215/083; G03G 2221/1648; G03G 15/0881; G03G 15/0898
See application file for complete search history.

(56) References Cited

U.S. PATENT DOCUMENTS 5,923,931 A * 7/1999 Kishimoto ..... G03G 15/0822 399/256
2004/0240907 A1* 12/2004 Miyaguchi ..... G03G 15/0818 399/254
2010/0111572 A1* 5/2010 Hori ..... G03G 15/0822 399/260

(Continued)

FOREIGN PATENT DOCUMENTS

JP 2010-134427 6/2010

*Primary Examiner* — Arlene Heredia
*Assistant Examiner* — Laura Roth
(74) *Attorney, Agent, or Firm* — XSENSUS LLP

(57) ABSTRACT

A developer accommodating device includes a rotator including a rotation shaft, a collar that rotates together with the rotation shaft, and a bearing rotatably supporting the rotation shaft via the collar. The rotation shaft includes a resin material, and collar including a metal material. The collar includes a collar main portion to be in sliding contact with the bearing, and a flange portion closer to a center of the rotator in an axial direction of the rotator than the collar main portion. The collar main portion has a first outer diameter, and the flange portion has a second outer diameter greater than the first outer diameter of the collar main portion.

11 Claims, 4 Drawing Sheets

(56) References Cited

U.S. PATENT DOCUMENTS

| | | | | |
|---|---|---|---|---|
| 2013/0084129 | A1* | 4/2013 | Ikeda | G03G 21/105 403/326 |
| 2016/0054684 | A1* | 2/2016 | Fujita | G03G 15/0891 399/254 |
| 2018/0136586 | A1 | 5/2018 | Tsuchiya et al. | |
| 2018/0143568 | A1 | 5/2018 | Ohhira et al. | |
| 2018/0275562 | A1* | 9/2018 | Nemoto | G03G 15/0891 |
| 2021/0041806 | A1 | 2/2021 | Tsuchiya et al. | |
| 2021/0364950 | A1* | 11/2021 | Kawashima | G03G 15/0889 |

* cited by examiner

DEVELOPER ACCOMMODATING DEVICE WITH SCREW INCLUDING SCREW BLADE AS ROTATOR, DEVELOPING DEVICE, PROCESS CARTRIDGE, AND IMAGE FORMING APPARATUS

CROSS-REFERENCE TO RELATED APPLICATION

This patent application is based on and claims priority pursuant to 35 U.S.C. § 119(a) to Japanese Patent Application No. 2021-097116, filed on Jun. 10, 2021 in the Japan Patent Office, the entire disclosure of which is hereby incorporated by reference herein.

BACKGROUND

Technical Field

Embodiments of the present disclosure generally relate to a developer accommodating device to store developer such as toner or two-component developer, a developing device including the developer accommodating device, a process cartridge, and an image forming apparatus.

Related Art

In a developer accommodating device (e.g., a developing device) installed in an image forming apparatus such as a copier or a printer, there are approaches to achieve both of reducing cost of a rotator (e.g., a conveying screw) and improving a sliding performance of a bearing. For example, the rotator is made of a resin material, and a rotation shall of the rotator is supported by the bearing via a collar made of a metal material.

SUMMARY

In one aspect, a developer accommodating device includes a rotator including a rotation shaft, a collar that rotates together with the rotation shaft, and a bearing rotatably supporting the rotation shaft via the collar. The rotation shaft includes a resin material, and collar including a metal material. The collar includes a collar main portion to be in sliding contact with the bearing, and a flange portion closer to a center of the rotator in an axial direction of the rotator than the collar main portion. The collar main portion has a first outer diameter, and the flange portion has a second outer diameter greater than the first outer diameter of the collar main portion.

In another aspect, a developing device includes a developer bearer to supply a developer to a latent image on a surface of an image bearer; and the developer accommodating device described above.

Another aspect concerns a process cartridge to be detachably installed in an image forming apparatus. The process cartridge includes the developing device described above; and the image bearer. The developing device and the image bearer are integral parts of the process cartridge.

In another aspect, an image forming apparatus includes the developer accommodating device described above.

In another aspect, an image forming apparatus includes the developing device described above.

In another aspect, a developer accommodating device includes a rotator including a rotation shaft and a screw blade spirally wound around the rotation shaft, a bearing rotatably supporting the rotation shaft, and a flange portion including a metal material. The flange portion is disposed closer to an end of the rotator in an axial direction of the rotator than the screw blade. The flange portion has an outer diameter equal to or greater than an outer diameter of the screw blade.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
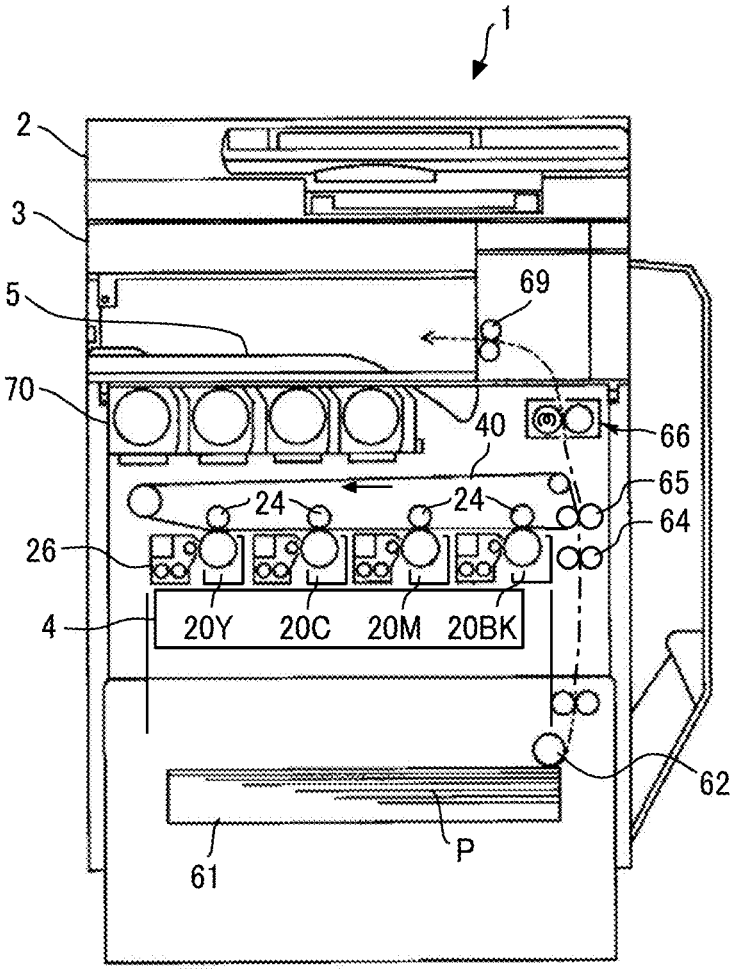
FIG. 1 is a diagram illustrating a general arrangement of an image forming apparatus according to one embodiment of the present disclosure.

The accompanying drawings are intended to depict embodiments of the present invention and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

Embodiments according to the present disclosure are described in detail with reference to drawings. It is to be understood that an identical or similar reference character is given to identical or corresponding parts throughout the drawings, and redundant descriptions are omitted or simplified below.

First, with reference to FIG. 1, a description is given of a configuration and an operation of an image forming apparatus 1 according to an embodiment of the present disclosure.

Figure 2:
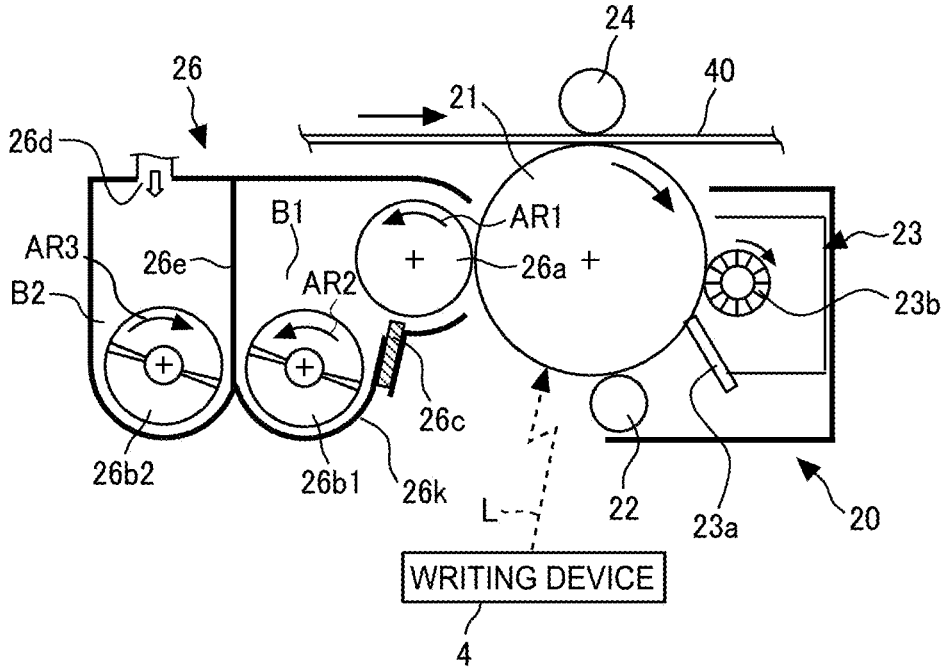
FIG. 2 is a cross-sectional view of an image forming unit of the image forming apparatus illustrated in FIG. 1.

The image forming apparatus 1 according to the present embodiment is a tandem multicolor image forming apparatus in which process cartridges 20Y, 20M, 20C, and 20BK are disposed in parallel to each other, facing an intermediate transfer belt 40. Referring also to FIG. 2, a developing device 26 as a developer accommodating device is installed so as to face a photoconductor drum 21 of each of the process cartridges 20Y, 20M, 20C, and 20BK (also collectively referred to as "process cartridges 20").

In FIG. 1, the image forming apparatus 1, which is, for example, a color copier, includes a document feeder 2, a document reading device 3, and a writing device 4 (an exposure device). The document feeder 2 conveys a document to be read, to the document reading device 3. The document reading device 3 reads an image of the document. The writing device 4 emits a laser beam based on image data generated by the document reading device 3.

The process cartridges 20Y, 20M, 20C, and 20BK form yellow, magenta, cyan, and black toner images, respectively. The yellow, magenta, cyan, and black toner images are transferred onto the intermediate transfer belt 40 and superimposed thereon.

The image forming apparatus 1 further includes a sheet feeder 61 to accommodate sheets P such as paper sheets, a secondary transfer roller 65 to transfer the toner image formed on the intermediate transfer belt 40 onto the sheet P, a fixing device 66 to fix the toner image on the sheet P, and toner containers 70 to supply yellow, magenta, cyan, and black toners to the developing devices 26 of the process cartridges 20Y, 20M, 20C, and 20BK, respectively.

Referring also to FIG. 2, each of the process cartridges 20Y, 20M, 20C, and 20BK is an integral unit including the photoconductor drum 21 as an image bearer, a charging device 22, and a cleaning device 23. In the image forming apparatus 1, each of the process cartridges 20Y, 20M, 20C, and 20BK is replaced with a new one when reaching the end of life.

The developing devices 26 are disposed so as to face the photoconductor drums 21 of the process cartridges 20Y, 20M, 20C, and 20BK. The developing device 26 replaced with a new one when reaching the end of life in the image forming apparatus 1. Attaching and detaching the developing device 26 to and from the image forming apparatus 1 and attaching and detaching the process cartridge 20 to and from the image forming apparatus 1 can be performed separately and independently.

In the process cartridges 20Y, 20M, 20C, and 20BK, the yellow, magenta, cyan, and black toner images are formed on the respective photoconductor drums 21 as the image bearers.

A description is given below of an operation of the image forming apparatus 1 to form a multicolor image.

Conveyance rollers of the document feeder 2 convey a document from a document table onto an exposure glass of the document reading device 3. The document reading device 3 optically reads an image of the document on the exposure glass and generates image data.

The document reading device 3 transmits yellow, magenta, cyan, and black image data to the writing device 4. The writing device 4 irradiates the photoconductor drums 21 (see FIG. 2) of the process cartridges 20Y, 20M, 20C, and 20BK with laser beams (exposure light) L based on the yellow, magenta, cyan, and black image data, respectively.

Meanwhile, the four photoconductor drums 21 rotate clockwise in FIGS. 1 and 2.

The surface of the photoconductor drum 21 is uniformly charged at a position facing the charging device 22 that is a charging roller (a charging process). Thus, the surface of the photoconductor drum 21 is charged to a certain potential. When the charged surface of the photoconductor drum 21 reaches a position to receive the laser beam L emitted from the writing device 4, an electrostatic latent image is formed on the surface of the photoconductor drum 21 according to the image data (an exposure process).

The surface of photoconductor drum 21 of the process cartridge 20Y, which is the first from the left in FIG. 1, of the four process cartridges 20 is irradiated with the laser beam L corresponding to a yellow component. The laser beam L corresponding to the yellow component is deflected by a polygon mirror that rotates at high speed so that the laser beam L scans the surface of the photoconductor drum 21 along an axial direction of the photoconductor drum 21 (i.e., the main scanning direction). Thus, an electrostatic latent image corresponding to the yellow component is formed on the photoconductor drum 21 charged by the charging device 22.

Similarly, the surface of the photoconductor drum 21 of the process cartridge 20C, which is the second from the left in FIG. 1, is irradiated with the laser beam L corresponding to a cyan component, and an electrostatic latent image for cyan is formed on the surface of the photoconductor drum 21. The surface of the photoconductor drum 21 of the process cartridge 20M, which is the third from the left in FIG. 1, is irradiated with the laser beam L corresponding to a magenta component. Thus, an electrostatic latent image corresponding to the magenta component is form on the surface of the photoconductor drum 21. The photoconductor drum 21 of the process cartridge 20BK, which is the fourth from the left in FIG. 1, is irradiated with the laser beam L corresponding to a black component. Thus, an electrostatic latent image corresponding to the black component is formed on the surface of the photoconductor drum 21.

Then, the surface of the photoconductor drum 21 carrying the electrostatic latent image reaches a position opposite the developing device 26. The developing device 26 supplies toner onto the surface of the photoconductor drum 21 and develops the electrostatic latent image on the photoconductor drum 21 into a toner image (a development process).

The surface of the photoconductor drum 21 having experienced the development process reaches a position facing the intermediate transfer belt 40. At positions facing the photoconductor drums 21 via the intermediate transfer belt 40, primary transfer rollers 24 are disposed in contact with an inner circumferential face of the intermediate transfer belt 40. At the positions facing the primary transfer rollers 24, the toner images on the photoconductor drums 21 are transferred to and superimposed on the intermediate transfer belt 40, forming a multicolor toner image thereon (primary transfer process).

After the primary transfer process, the surface of the photoconductor drum 21 reaches a position opposite the cleaning device 23. The cleaning device 23 collects un transferred toner remaining on the photoconductor drum 21 (a cleaning process).

Subsequently, a residual potential on the surface of the photoconductor drum 21 is removed at a position facing a discharger. Thus, a series of image forming process performed on the photoconductor drum 21 is completed.

Meanwhile, the surface of the intermediate transfer belt 40, onto which the single-color toner images on the photoconductor drums 21 are superimposed, moves in the direction indicated by an arrow drawn adjacent to the intermediate transfer belt 40 in FIG. 1 and reaches a position opposed to the secondary transfer roller 65. The secondary transfer roller 65 secondarily transfers the multicolor toner image on the intermediate transfer belt 40 to the sheet P (secondary transfer process).

After the secondary transfer process, the surface of the intermediate transfer belt 40 reaches a position opposite a belt cleaner. The belt cleaner collects untransferred toner on the intermediate transfer belt 40, and a series of transfer process on the intermediate transfer belt 40 is completed.

The sheet P is conveyed to the position of the secondary transfer roller 65 via a registration roller pair 64 from the sheet feeder 61.

Specifically, a feed roller 62 feeds, one by one, the sheets P stored in the sheet feeder 61. The sheet P is conveyed to the registration roller pair 64 through a sheet conveyance passage. The sheet P that has reached the registration roller pair 64 is conveyed toward the secondary transfer roller 65, timed to coincide with the multicolor toner image on the intermediate transfer belt 40.

Subsequently, the sheet P, onto which the multicolor image has been transferred, is conveyed to the fixing device 66. The fixing device 66 includes a fixing roller and a pressure roller pressing against each other. In a nip between the fixing roller and the pressure roller, the multicolor image is fixed on the sheet P.

After the fixing process, an output roller pair 69 ejects the sheet P as an output image outside the image forming apparatus 1. The ejected sheet P is stacked on an output tray 5. Thus, a series of image forming processes ends.

Next, the image forming units of the image forming apparatus 1 are described in further detail below with reference to FIGS. 2 and 3.

The four image forming units installed in the image forming apparatus 1 have a similar configuration except the color of the toner used in the image forming processes. In the drawings, suffixes Y, M, C, and BK, which denote the color of the toner, are omitted from the reference characters of components of the image forming unit such as the process cartridge 20 and the developing device 26.

As illustrated in FIG. 2, the process cartridge 20 mainly includes the photoconductor drum 21 as the image bearer, the charging device 22, and the cleaning device 23, which are contained in a case of the process cartridge 20 as a single unit.

The photoconductor drum 21 is an organic photoconductor designed to be charged with a negative polarity and includes a photosensitive layer on a drum-shaped conductive support.

The charging device 22 is a charging roller including a conductive core and an elastic layer of moderate resistivity overlaid on the conductive core. The charging device 22 (the charging roller) is applied with a given voltage by a power supply and uniformly charges the surface of the photoconductor drum 21 opposite the charging device 22.

The cleaning device 23 includes a cleaning blade 23*a* and a cleaning roller 23*b* that contact the photoconductor drum 21. The cleaning blade 23*a* is made of, for example, rubber such as urethane rubber, and contacts the surface of the photoconductor drum 21 at a predetermined angle with a predetermined pressure. The cleaning roller 23*b* is a brush roller in which brush bristles are provided on the circumference of the core.

Figure 3:
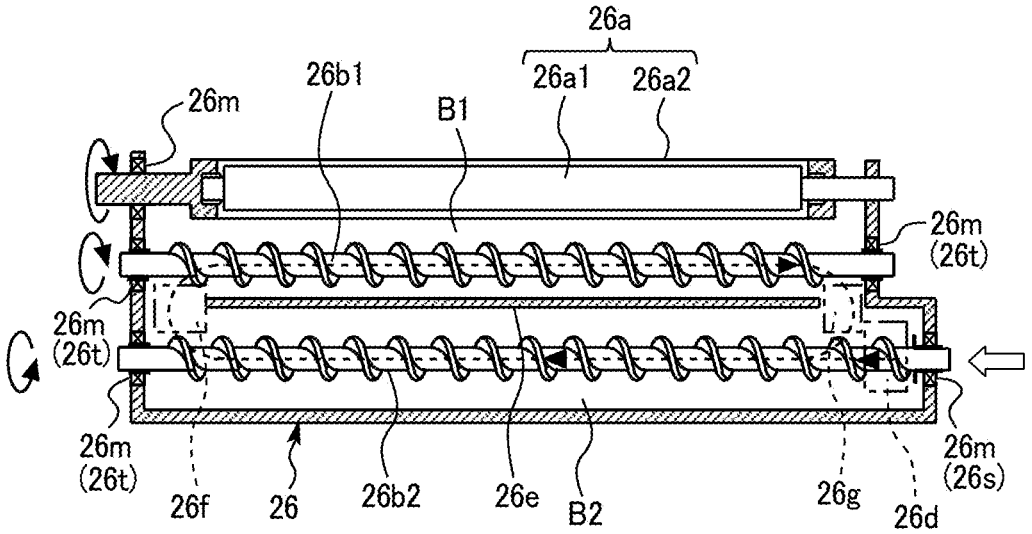
FIG. 3 is a schematic cross-sectional view of a developing device of the image forming unit illustrated in FIG. 2 as viewed along a longitudinal direction of the developing device.

As illustrated in FIGS. 2 and 3, the developing device 26 as the developer accommodating device mainly includes a developing roller 26*a* as a developer bearer, a first conveying screw 26*b*1 facing the developing roller 26*a*, a partition 26*e*, a second conveying screw 26*b*2 facing the first conveying screw 26*b*1 via the partition 26*e*, and a doctor blade 26*c* as a developer regulator facing the developing roller 26*a*. The doctor blade 26*c* regulates the amount of developer borne on the developing roller 26*a*. The first and second conveying screws 26*b*1 and 26*b*2 convey the developer, and the second conveying screw 26*b*2 serves as a rotator to be described later.

The developing device 26 stores a two-component developer including carrier and toner.

The developing roller 26*a* is disposed facing the photoconductor drum 21 with a small gap, thereby forming a developing range. As illustrated in FIG. 3, the developing roller 26*a* includes a stationary magnet 26*a*1 secured inside and a sleeve 26*a*2 that rotates around the magnet 26*a*1. The magnet 26*a*1 generates multiple magnetic poles on an outer circumferential surface of the developing roller 26*a*.

The first conveying screw 26*b*1 and the second conveying screw 26*b*2 convey the developer stored in the developing device 26 in the longitudinal direction of the developing device 26, thereby forming a circulation passage indicated by the dashed arrow in FIG. 3.

That is, the first conveying screw 26*b*1 forms a first conveyance passage B1, and the second conveying screw 26*b*2 forms a second conveyance passage B2. The first and second conveyance passages B1 and B2 form the circulation passage of developer.

The partition 26*e* separates the first conveyance passage B1 from the second conveyance passage B2, but the first and second conveyance passages B1 and B2 communicate with each other via first and second communication openings 26*f* and 26*g* at both ends of the first and second conveyance passages B1 and B2. Specifically, with reference to FIG. 3, in the developer conveyance direction, an upstream end of the first conveyance passage B1 communicates with a downstream end of the second conveyance passage B2 via the first communication opening 26*f*. A downstream end of the first conveyance passage B1 communicates with an upstream end of the second conveyance passage B2 via the second communication opening 26*g*. That is, the partition 26*e* is disposed along the circulation passage except both ends in the longitudinal direction of the circulation passage.

The first conveying screw 26*b*1 (the first conveyance passage B1) is opposed to the developing roller 26*a*, and the second conveying screw 26*b*2 (the second conveyance passage B2) is opposed to the first conveying screw 26*b*1 (the first conveyance passage B1) via the partition 26*e*. The first conveying screw 26*b*1 supplies the developer toward the developing roller 26*a* and collects the developer having been used in the development process and separated from the developing roller 26*a* while conveying the developer in the longitudinal direction of the developing device 26. The second conveying screw 26*b*2 stirs and mixes the developer having been used in the development process, conveyed from the first conveyance passage B1, with a fresh toner supplied from a supply port 26*d* while conveying the developer in the longitudinal direction of the developing device 26.

Figure 4:
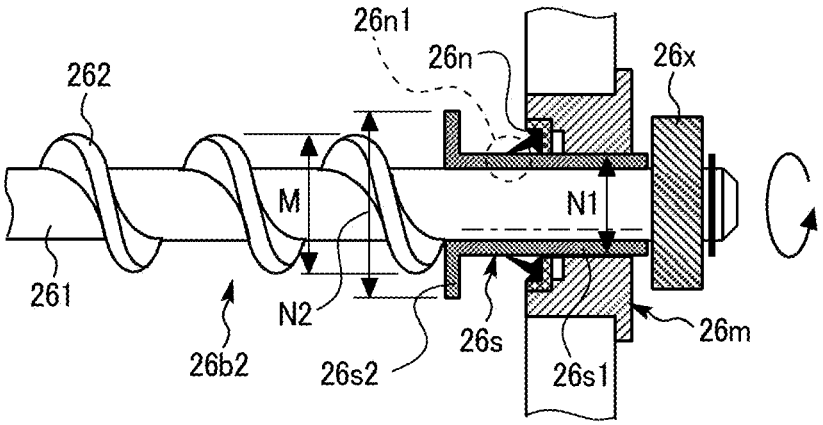
FIG. 4 is a cross-sectional view of the vicinity of a bearing that supports a conveying screw of the developing device illustrated in FIG. 3.

In the present embodiment, the first and second conveying screws 26*b*1 and 26*b*2 are disposed in parallel in the horizontal direction. As illustrated in FIG. 4, each of the first and second conveying screws 26*b*1 and 26*b*2 is a screw including a rotation shaft 261 and a screw blade 262 helically provided around the rotation shaft 261.

Referring now to FIGS. 2 and 3, a detailed description is given of the image forming process described above, focusing on the development process.

The developing roller 26*a* rotates in the direction indicated by arrow AR1 in FIG. 2. As illustrated in FIG. 3, the first and second conveying screws 26*b*1 and 26*b*2, between which the partition 26*e* is interposed, rotate in the directions indicated by arrows AR2 and AR3 in FIG. 3, respectively.

With the rotations, the developer in the developing device 26 is stirred and mixed with the toner supplied from the toner container 70 through a toner supply passage and the supply port 26*d* while circulated in the longitudinal direction of the developing device 26 as indicated by the dashed arrow in FIG. 3.

The toner is charged by friction with the carrier and electrostatically attracted to the carrier. Then, the toner is scooped up onto the developing roller 26*a* together with the carrier by a developer scooping pole generated on the developing roller 26*a*. The developing roller 26*a* conveys the developer borne thereon the developing roller 26*a* in the direction indicated by arrow AR1 in FIG. 2 to a position facing the doctor blade 26*c*. The doctor blade 26*c* adjusts the amount of the developer on the developing roller 26*a* at the position, Subsequently, the developing roller 26*a* supplies by rotation the developer to the developing range in which the developing roller 26*a* faces the photoconductor drum 21. The toner in the developer is attracted to the electrostatic latent image formed on the photoconductor drum 21 due to the effect of an electric field generated in the developing range. That is, the developing roller 26*a* supplies the developer to the photoconductor drum 21 (image bearer). As the sleeve 26*a*2 rotates, the developer G remaining on the developing roller 26*a* reaches above the first conveyance passage B1 and separates from the developing roller 26*a*. The electric field in the development range is generated by a predetermined voltage (a development bias) applied to the developing roller 26*a* by a development power supply and a surface potential (a latent image potential) generated on the photoconductor drum 21 in the charging process and the exposure process.

The toner contained in the toner container 70 is supplied through the supply port 26*d* to the developing device 26 as the toner in the developing device 26 is consumed. The toner consumption in the developing device 26 is detected by a toner concentration sensor that magnetically detects the ratio of toner to the developer) in the developing device 26.

The supply port 26*d* is disposed above the second conveying screw 26*b*2 (the second conveyance passage B2) and at an end of the second conveying screw 202 in the longitudinal direction (the lateral direction in FIG. 3).

Further, in the developing device 26 according to the present embodiment, as indicated by an outlined arrow in FIG. 3, a driving force is transmitted (input) to the second conveying screw 26*b*2 from a drive motor installed in the body of the image forming apparatus 1. The driving force input to the second conveying screw 26*b*2 is transmitted to the first conveying screw 26*b*1 and the developing roller 26*a* via a gear train. Then, the components of the developing device 26 rotate in the directions indicated by the arrows in FIG. 3.

A description is given in further detail below of the configuration and operation of the developing device 26 as the developer accommodating device according to the present embodiment.

As described above with reference to FIGS. 2 and 3, the developing device 26 as the developer accommodating device accommodates the two-component developer as the developer.

The developing device 26 (developer accommodating device) includes the first and second conveying screws 26*b*1 and 26*b*2. As illustrated in FIG. 4, each of the first and second conveying screws 26*b*1 and 26*b*2 includes the rotation shaft 261 made of metal and the screw blade 262 helically winding around the rotation shaft 261.

In the present embodiment, of the two conveying screws 26*b*1 and 26*b*2, the second conveying screw 26*b*2 is a rotator in which a first collar 26*s* described later is press-fitted on a first end of the rotation shaft 261. The first end of the rotation shaft 261 is on a drive side on which a gear 26*x* is disposed.

In the present embodiment, the first conveying screw 26*b*1 has substantially the same configuration as that of the second conveying screw 26*b*2 except that the second collars 26*t* (another collar) different from the first collar 26*s* are press-fitted on the rotation shaft 261. The description of the common components will be simplified as appropriate.

As illustrated in FIGS. 3 and 4, in the present embodiment, the second conveyance passage B2 of the developing device 26 includes the second conveying screw 26*b*2 as a rotator, the first collar 26*s*, the second collars 26*t*, bearings 26*m*, a seal 26*n*, and the like. The second conveyance passage B2 is an example of the developer accommodating device.

As illustrated in FIG. 4, the second conveying screw 26*b*2 (the rotator) includes the rotation shaft 261 made of a resin material and the screw blade 262 helically winding around the rotation shaft 261.

In the present embodiment, the second conveying screw 26*b*2 is produced by, for example, injection molding so that the rotation shaft 261 and the screw blade 262 are integral with each other and made of the same resin material. The first conveying screw 26*b*1 has the same configuration as that of the second conveying screw 26*b*2 (common components).

Forming the rotation shafts 261 (the first conveying screw 26*b*1 and the second conveying screw 26*b*2) using a resin material reduces the cost and the weight of the apparatus as compared with a case where the rotation shafts are formed using a metal material.

As illustrated in FIG. 4, the first collar 26*s* is substantially cylindrical and made of a metal material. The first collar 26*s* rotates together with the rotation shaft 261.

In the present embodiment, the first collar 26*s* is press-fitted on the rotation shaft 261 of the second conveying screw 26*b*2.

The first collar 26*s* is interposed between the rotation shaft 261 and the bearing 26*m* to prevent direct sliding contact of the rotation shaft 261 made of a resin material with the bearing 26*m*. In other words, the bearing 26*m* rotatably supports the rotation shaft 261 (the second conveying screw 26*b*2) via the first collar 26*s*.

If the rotation shaft 261 made of a resin material is subjected to direct sliding contact with the bearing 26*m*, the sliding resistance increases, which is not desirable since the rotation shaft 261 and the bearing 26*m* wear and deteriorate, and the driving torque of the apparatus increases.

By contrast, in the present embodiment, the rotation shaft 261 made of a resin material is not brought into direct contact with the bearing 26*m*, but the first collar 26*s* made of a metal material is brought into sliding contact with the bearing 26*m*. This configuration alleviates the sliding resistance between the second conveying screw 26*b*2 and the hearing 26*m*, and restricts the above-described inconveniences.

The material of the first collar 26*s* is, for example, free-cutting steel (SUM material) having a nickel-plated outer surface.

In the present embodiment, the first collar 26*s* includes a collar main portion 26*s*1 and a flange portion 26*s*2. The collar main portion 26*s*1 is brought into sliding contact with the bearing 26*m*. The flange portion 26*s*2 is positioned on an end side of the first collar 26*s* (left side in FIG. 4) closer to the center in the longitudinal direction of the developing device 26. The collar main portion **26*s*1 has a first outer diameter, and the flange portion 26*s*2 has a second outer diameter greater than the first outer diameter of the collar main portion 26*s*1**.

Hereinafter, "axial direction" and "longitudinal direction" refers to the direction along the axis of the developing roller **26*a*, the first conveying screw 26*b*1, or the second conveying screw 26*b*2 unless otherwise specified. Additionally, "first end side" or "drive side" of the developing device 26 refers to the end side (right side in FIG. 3) in the longitudinal direction on which the gear 26*x* and the first collar 26*s* are positioned, and "second end side" refers to the opposite side (left side in FIG. 3**) of the first end side.

To be specific, in the first collar **26*s* according to the present embodiment, the collar main portion 26*s*1 has a first outer diameter N1 that is substantially equal to an inner diameter of the bearing 26*m*, and the flange portion 26*s*2 has a second outer diameter N2 that is sufficiently greater than the outer diameter N1 of the collar main portion 26*s*1 (in a range indicated by an alternate long and short dashed lines in FIG. 4) (N2>>N1). The first collar 26*s* is disposed such that the flange portion 26*s*2 faces the center of the developing device 26** in the axial direction.

Referring to FIG. 4, the bearing **26*m* rotatably supports the rotation shaft 261 via the first collar 26*s***.

Specifically, in the present embodiment, the bearing **26*m* is a sliding bearing made of a low-friction resin material. The bearing 26*m* has a substantially doughnut shape. The bearing 26*m* is inserted into a hole in a developing case (which is a housing of the developing device 26) with a flange portion thereof is in contact with an outer wall of the developing case. The bearing 26*m*** is shaped to fit with a stopper portion formed in the hole of the developing case so as to be held in the developing case not to rotate.

The rotation shaft 261 inserted into the bearing **26*m* is fitted in the gear 26*x* (to which drive is transmitted from the main body of the image forming apparatus 1). In this state, a retaining ring is attached to a groove of the rotation shaft 261 protruding to the outside (right side in FIG. 4) of the bearing 26*m*, and the position of the second conveying screw 26*b*2 in the developing device 26** in the axial direction is determined.

Further, the seal **26*n* is press-fitted inside the bearing 26*m*** in the diameter direction.

The seal **26*n* is a G seal or the like and includes a substantially annular lip portion 26*n*1 (made of a rubber material having a low affinity for toner). The lip portion 26*n*1 is brought into sliding contact with the outer surface of the collar main portion 26*s*1**.

Specifically, the lip portion **26*n*1 comes into sliding contact with the outer surface of the collar main portion 26*s*1 in a clearance between the flange portion 26*s*2 and the bearing 26*m* in the axial direction. This configuration minimizes the developer entering a gap between the bearing 26*m* and the second conveying screw 26*b*2 (the first collar 26*s***).

As described above, in the developing device 26 according to the present embodiment, the rotation shaft 261 (the second conveying screw **26*b*2) made of a resin material is supported by the bearing 26*m* via the first collar 26*s* including the flange portion 26*s*2**.

Accordingly, even when the developer enters the gap between the bearing **26*m* and the first collar 26*s***, risk of aggregation of the developer is reduced.

Specifically, since the first collar **26*s* is made of a metal material, the temperature of the first collar 26*s* is easily raised by sliding contact with the bearing 26*m*. When the developer enters the gap between the bearing 26*m* and the first collar 26*s*, the developer is likely to aggregate due to heat of the first collar 26*s* (heat generated by sliding contact between the bearing 26*m* and the first collar 26*s*). If such aggregation of the developer occurs, the developer eventually solidifies between the bearing 26*m* and the first collar 26*s*, and the second conveying screw 26*b*2** is easily locked.

On the other hand, according to the present embodiment, the first collar **26*s* includes the flange portion 26*s*2 having a sufficiently large outer diameter. With this configuration, as compared with a configuration in which the flange portion 26*s*2 is not formed, the thermal capacity is increased, and heat dissipation is promoted. Thus, the temperature is less likely to rise. Accordingly, even when the developer enters the gap between the bearing 26*m* and the first collar 26*s***, risk of aggregation of the developer is reduced.

Further, in the present embodiment, the flange portion **26*s*2 of the first collar 26*s* is located inside the developing device 26 so that a part or all of the flange portion 26*s*2** is embedded in the developer in the device.

With this configuration, as compared with the case where the flange portion **26*s*2 is not formed, the contact area of the first collar 26*s* with the developer in the apparatus is increased, and heat of the first collar 26*s* is diffused by the developer flowing in the device. Then, the first collar gap is easily cooled. Accordingly, even when the developer enters the gap between the bearing 26*m* and the first collar 26*s*, risk of aggregation of the developer is further reduced. In addition, since the temperature of the first collar 26*s* itself is less likely to increase, the risk of aggregation of the developer in the developing device 26** due to heat is reduced, and the occurrence of an image defect such as a white streak (toner is partly absent) due to toner aggregation is reduced.

In particular, in the present embodiment, the flange portion **26*s*2 of the first collar 26*s* has the outer diameter N2 that is equal to or greater than an outer diameter M of the screw blade 262 (N2**>M).

This configuration sufficiently increases the thermal capacity of the first collar **26*s*, and the temperature rise is better prevented. Accordingly, even when the developer enters the gap between the bearing 26*m* and the first collar 26*s*, risk of aggregation of the developer is further reduced. This configuration also inhibits aggregation of the developer accommodated in the developing device 26**, and the occurrence of an image defect such as a white streak (toner is partly absent) is further reduced.

In the present embodiment, as illustrated in FIG. 4, the first collar **26*s* is disposed such that the flange portion 26*s*2 contacts the screw blade 262**.

With this configuration, the position of the first collar **26*s* in the axial direction can be easily determined without installing, on the rotation shaft 261, a retaining ring or the like that contacts the end face of the flange portion 26*s*2. In particular, in the present embodiment, the first collar 26*s* is press-fitted on the rotation shaft 261. In the press-fitting assembling, the first collar 26*s* is press-fitted to a position where the first collar 26*s* contacts the screw blade 262**, which is simple. Thus, the assembling is easy, and variations in the press-fitting position are reduced.

Further, in the present embodiment, the second conveying screw **26*b*2 as the rotator does not include a large-diameter portion that is greater in outer diameter than the rotation shaft 261, except for the screw blade 262. That is, the second conveying screw 26*b*2 does not include a flange portion or the like having an outer diameter greater than that of the rotation shaft 261 except for the screw blade 262**.

With this configuration, the momentum of the developer flowing in the developing device 26 is not reduced and the developer easily contacts the flange portion 26*s*2 of the second conveying screw 26*b*2, as compared with a conveying screw including such a large diameter portion. Therefore, the effect of cooling the first collar 26*s* described above is easily exhibited.

As illustrated in FIG. 4, in the developing device 26 according to the present embodiment, the flange portion 26*s*2 is across a clearance from the bearing 26*m* in the axial direction.

That is, the flange portion 26*s*2 is disposed at a position sufficiently separated from the hearing 26*m* inside the developing device 26.

Accordingly, the flange portion 26*s*2 easily contacts the developer smoothly flowing in the developing device 26, and thus the effect of cooling the first collar 26*s* described above is easily exhibited.

Referring to FIG. 3 (and FIG. 5), in the present embodiment, the first collar 26*s* and the second collar 26*t* which is also cylindrical are disposed on the rotation shaft 261 of the second conveying screw 26*b*2 (rotator). The first collar 26*s* is disposed in a first end portion (on the right in FIG. 3) in the axial direction which is the drive side provided with the gear 26*x* to receive a drive force. The second collar 26*t* (see FIG. 5) is disposed in a second end portion (on the left in FIG. 3) in the axial direction which is a non-drive side.

The second collar 26*t* is similar in configuration to the first collar 26*s* except that the flange portion 26*s*2 is not formed and the installation position is different.

The reason of this configuration is described. Compared with the drive side, on the non-drive side, the torque applied to the rotation shaft 261 is smaller, and the sliding resistance between the bearing 26*m* and the rotation shaft 261 (collar) is smaller. Accordingly, the temperature of the collar is less likely to rise. That is, the temperature of the second collar 26*t* is less likely to rise compared with that of the first collar 26*s*.

Further, the second collar 26*t* is less expensive than the first collar 26*s* because the flange portion 26*s*2 is not formed.

For this reason, in the present embodiment, only the first collar 26*s* that is likely to be heated includes the flange portion 26*s*2, and the second collar 26*t* does not include the flange portion 26*s*2. Thus, while aggregation of developer entering between a bearing and a collar is efficiently prevented, the cost of the device is reduced.

Figure 5:
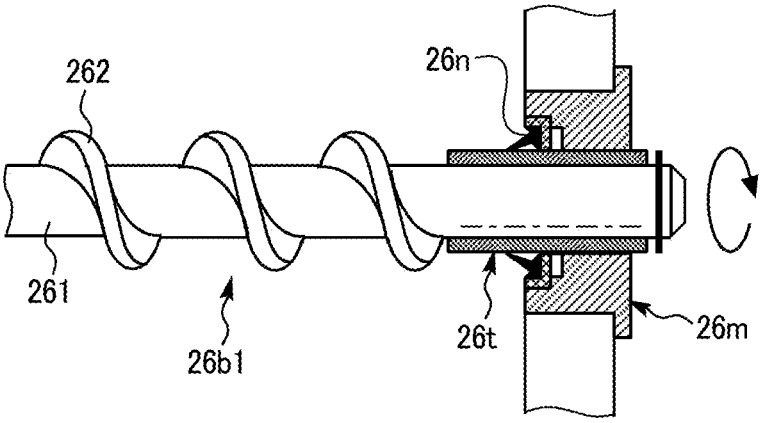
FIG. 5 is a cross-sectional view of the vicinity of a bearing that supports another conveying screw of the developing device illustrated in FIG. 3.

Referring to FIGS. 3 and 5, in the first conveying screw 26*b*1 according to the present embodiment, the second collars 26*t* (cylindrical collars without a flange portion) are used as the two collars press-fitted to both end of the rotation shaft 261.

This is because, compared with the drive side of the second conveying screw 26*b*2, the torque applied to the rotation shaft 261 of the first conveying screw 26*b*1 is smaller, and the sliding resistance between the bearing 26*m* and the rotation shaft 261 (collar) is smaller. Accordingly, the temperature of the collar is less likely to rise. That is, the second collar 26*t* provided on the first conveying screw 26*b*1 is less likely to be heated than the first collar 26*s* provided on the second conveying screw 26*b*2.

Further, the second collar 26*t* is less expensive than the first collar 26*s* because the flange portion 26*s*2 is not formed.

For this reason, in the present embodiment, the flange portion 26*s*2 is not provided to the first conveying screw 26*b*1 that is not likely to be heated. That is, among the four collars installed on the first and second conveying screws 26*b*1 and 26*b*2, only the collar (installed on the drive side of the second conveying screw 26*b*2) that is most likely to be heated includes the flange portion 26*s*2. Thus, while aggregation of developer entering between a bearing and a collar is efficiently prevented, the cost of the device is reduced.

A description is given of a modification of the above-described embodiment.

Figure 6:
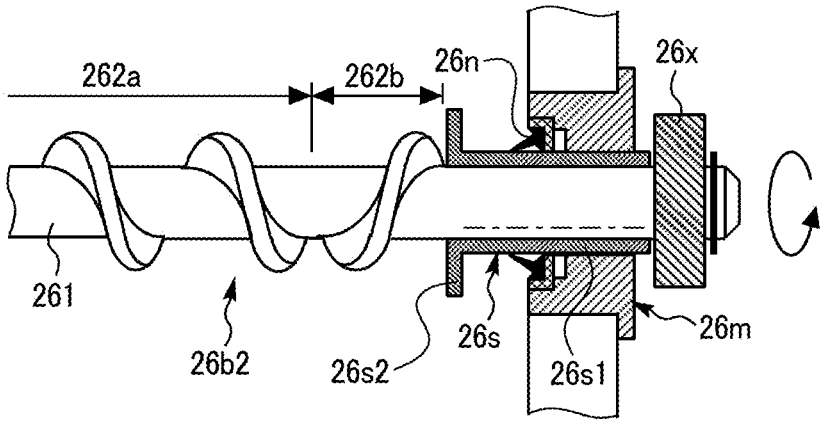
FIG. 6 is a cross-sectional view of the vicinity of a bearing that supports a conveying screw, according to a modification.

As illustrated in FIG. 6, in the developing device 26 (developer accommodating device) according to the modification, the second conveying screw 26*b*2 as the rotator includes a reversed screw blade (a second screw blade 262*b*) extending from the end of the screw blade that contacts the flange portion 26*s*2 to the center side of the second conveying screw 26*b*2 in the axial direction. The reversed screw blade (the second screw blade 262*b*) has a winding direction reverse to the winding direction of the rest (a first screw blade 262*a*) of the screw blade.

To be specific, in the second conveying screw 26*b*2, the screw blade wound around the rotation shaft 261 includes the second screw blade 262*b* disposed in an axial end portion on the first collar 26*s* side, and the first screw blade 262*a* extending from the second screw blade 262*h* to the second collar 26*t* (see FIG. 3). The winding direction (spiral direction) of the first screw blade 262*a* is the same direction as that of the screw blade 262 in FIG. 4, and the winding direction of the second screw blade 262*h* is opposite to that of the first screw blade 262*a*. The first and second screw blades 262*a* and 262*b* have a screw pitch and an outer diameter that are similar to those of the screw blade 262 illustrated in FIG. 4. The second screw blade 262*b* extends a range of at least one screw pitch.

Owing to the second screw blade 262*h* having the winding direction opposite to that of the first screw blade 262*a*, the developer flowing in the vicinity of the flange portion 26*s*2 in the developing device 26 contacts the flange portion 26*s*2 while being actively replaced. This configuration facilitates cooling of the first collar 26*s*, and the developer entering between the bearing 26*m* and the first collar 26*s* or the developer accommodated in the developing device 26 is less likely to aggregate.

As described above, the developing device 26 according to the present embodiment is a developer accommodating device that accommodates developer, and includes the second conveying screw 26*b*2 (rotator) including the rotation shaft 261 made of a resin material, the first collar 26*s* that is made of a metal material and rotates together with the rotation shaft 261, and the bearing 26*m* that rotatably supports the rotation shaft 261 via the first collar 26*s*. The first collar 26*s* includes the flange portion 26*s*2 having the second outer diameter N2 greater than the first outer diameter N1 of the collar main portion 26*s*1 that slidingly contacts the bearing 26*m*. The flange portion 26*s*2 is at one axial end of the first collar 26*s* closer to the center of the developing device 26 in the axial direction of the rotation shaft 261.

This configuration reduces the risk of aggregation of the developer that has entered between the bearing 26*m* and the first collar 26*s*.

In the present embodiment, the developing device 26 is not a component of the process cartridge 20 but is a unit that is independently attached to and detached from the main body of the image forming apparatus 1. Alternatively, the developing device 26 may be a component of the process cartridge 20 and be attached to and detached from the main body of the image forming apparatus 1 together with other components of the process cartridge 20.

Such a configuration also provides similar effects to those of the above-described embodiment and the variation.

Note that the term "process cartridge" used in the present disclosure refers to a removable device (a removable unit) including an image bearer and at least one of a charging device to charge the image bearer, a developing device to develop latent images on the image bearer, and a cleaning device to clean the image bearer that are united together, and is designed to be removably installed in the image forming apparatus.

In the embodiment described above, the developing device 26 includes the two conveying screws 26*b*1 and 26*b*2 (conveyors) that are horizontally parallel and the doctor blade 26*c* disposed below the developing roller 26*a* Aspects of the present disclosure are applicable to, not only the developing devices having the above-described configurations, but also, for example, a developing device in which three or more conveying screws are arranged in parallel in the horizontal direction, a developing device in which multiple conveyors are arranged in parallel in the vertical direction, and a developing device in which the doctor blade is disposed above the developing roller.

In the above-described embodiment, the developing device 26 accommodates the two-component developer including toner and carrier. Alternatively, aspects of the present disclosure are applicable to a developing device that accommodates one-component developer (i.e., toner, which may include external additives).

Such a configuration also provides effects similar to those described above.

Further, in the above-described embodiment, the developing device 26 is described as a developer accommodating device to which aspects of the present disclosure are applied, but the developer accommodating device is not limited to thereto, but can be any device that accommodates developer, such as a toner container, a toner supply device, a cleaning device, a toner conveying device, and a waste-toner container.

Further, in the above-described embodiment, the flange portion 26*s*2 is provided only to the first collar 26*s* (on the drive side) of the two collars 26*t* and 26*s* that are press-fitted to the second conveying screw 26*b*2 as the rotator. Alternatively, also the second collar 26*t* (on the non-drive side) may include the flange portion. Further, at least one of the two collars press-fitted to the first conveying screw 26*b*1 as the rotator may include a flange portion. Further, aspects of the present disclosure can be applied to a rotator (for example, a developing roller 26*a*) other than the conveying screws 26*b*1 and 26*b*2.

Such a configuration also provides effects similar to those described above.

Note that it is apparent that embodiments according to the present disclosure are not limited to the above-described embodiment and the modification, and that each embodiment can be modified as appropriate in addition to those suggested in the above-described embodiment and the modification within the scope of the technical idea of the present disclosure. The number, position, and shape of the components described above are not limited to those described above but can be changed to number, position, and shape preferable to embody the present disclosure.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

The invention claimed is:

1. A developer accommodating device, comprising:

a rotator including a rotation shaft including a resin material;

a collar including a metal material and configured to rotate together with the rotation shaft; and a bearing rotatably supporting the rotation shaft via the collar, the collar including:

a collar main portion having a first outer diameter and configured to be in sliding contact with the bearing; and a flange portion closer to a center of the rotator in an axial direction of the rotator than the collar main portion, the flange portion having a second outer diameter greater than the first outer diameter of the collar main portion, wherein the rotator is a screw and further includes a screw blade spirally wound around the rotation shaft, and wherein the second outer diameter of the flange portion is equal to or greater than an outer diameter of the screw blade.

2. The developer accommodating device according to claim 1, wherein the flange portion of the collar is in contact with an end of the screw blade.

3. The developer accommodating device according to claim 2, wherein the screw blade includes:

a first screw blade extending from an end of the screw blade opposite the end of the screw blade in contact with the flange portion; and a second screw blade including the end of the screw blade in contact with the flange portion, the second screw blade having a winding direction reverse to a winding direction of the first screw blade.

4. The developer accommodating device according to claim 1, wherein, except for the screw blade, the rotator is free of a large-diameter portion having an outer diameter greater than a diameter of the rotation shaft.

5. The developer accommodating device according to claim 1, wherein the collar is disposed on a first end portion of the rotation shaft in the axial direction, the first end portion being a drive side, and wherein the developer accommodating device further comprises another collar that is cylindrical, the another collar being disposed on a second end portion of the rotation shaft opposite the first end portion, the second end portion being a non-drive side.

6. The developer accommodating device according to claim 1, wherein the flange portion is across a clearance from the bearing in the axial direction.

7. The developer accommodating device according to claim 6, further comprising a seal press-fitted inside the bearing, the seal including a lip portion configured to slidably contact an outer surface of the collar main portion in the clearance.

8. A developing device comprising:

a developer bearer configured to supply a developer to a latent image on a surface of an image bearer; and the developer accommodating device according to claim 1.

9. A process cartridge to be detachably installed in an image forming apparatus, the process cartridge comprising:

the developing device according to claim 8; and the image bearer, wherein the developing device and the image bearer are integral parts of the process cartridge.

10. An image forming apparatus comprising the developing device according to claim 8.

11. An image forming apparatus comprising the developer accommodating device according to claim 1.

* * * * *